United States Patent [19]

Bastenhof et al.

[11] 4,038,825

[45] Aug. 2, 1977

[54] PNEUMATIC METHOD AND DEVICE FOR DIESEL ENGINE BRAKING AND RESTARTING IN THE REVERSE DIRECTION

[75] Inventors: Dirk Bastenhof, Eaubonne; Alain Devaux, Saint Mande, both of France

[73] Assignee: Societe d'Etudes de Machines Thermiques, Saint Denis, France

[21] Appl. No.: 615,367

[22] Filed: Sept. 22, 1975

[30] Foreign Application Priority Data

Sept. 26, 1974 France ..... 74.32495

[51] Int. Cl.[2] ..... F02N 9/04

[52] U.S. Cl. ..... 60/631; 123/41 R

[58] Field of Search ..... 60/631, 625, 630; 123/41 R, 41 E

[56] References Cited

U.S. PATENT DOCUMENTS

| | | | |
|---|---|---|---|
| 1,094,591 | 4/1914 | Le Pontois | 123/41 E |
| 1,220,011 | 3/1917 | Scognamillo | 123/41 E |
| 1,220,805 | 3/1917 | Weiss | 60/631 |
| 1,246,361 | 3/1917 | Unckles | 60/631 |
| 1,264,994 | 5/1918 | Sumner | 60/631 |
| 1,618,937 | 2/1927 | MacPherson et al. | 60/631 |
| 1,723,699 | 8/1929 | Huss | 60/631 |
| 1,866,234 | 7/1932 | Thege | 60/631 |

*Primary Examiner*—Allen M. Ostrager
*Attorney, Agent, or Firm*—Jay L. Chaskin

[57] ABSTRACT

A method and a device for pneumatically braking and re-starting in the reverse direction a Diesel engine, comprising stopping the fuel supply to the engine, locking starting valves of the engine in an open position during the braking period, and then opening a main starting valve and the exhaust ports of the starting valves when the engine has slowed down to a rotary speed of a predetermined value.

8 Claims, 3 Drawing Figures

Fig. 1.
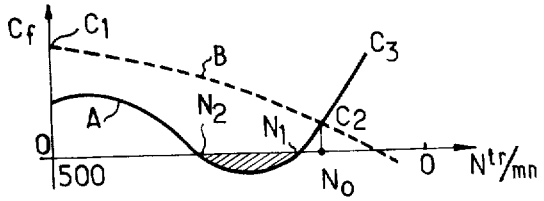
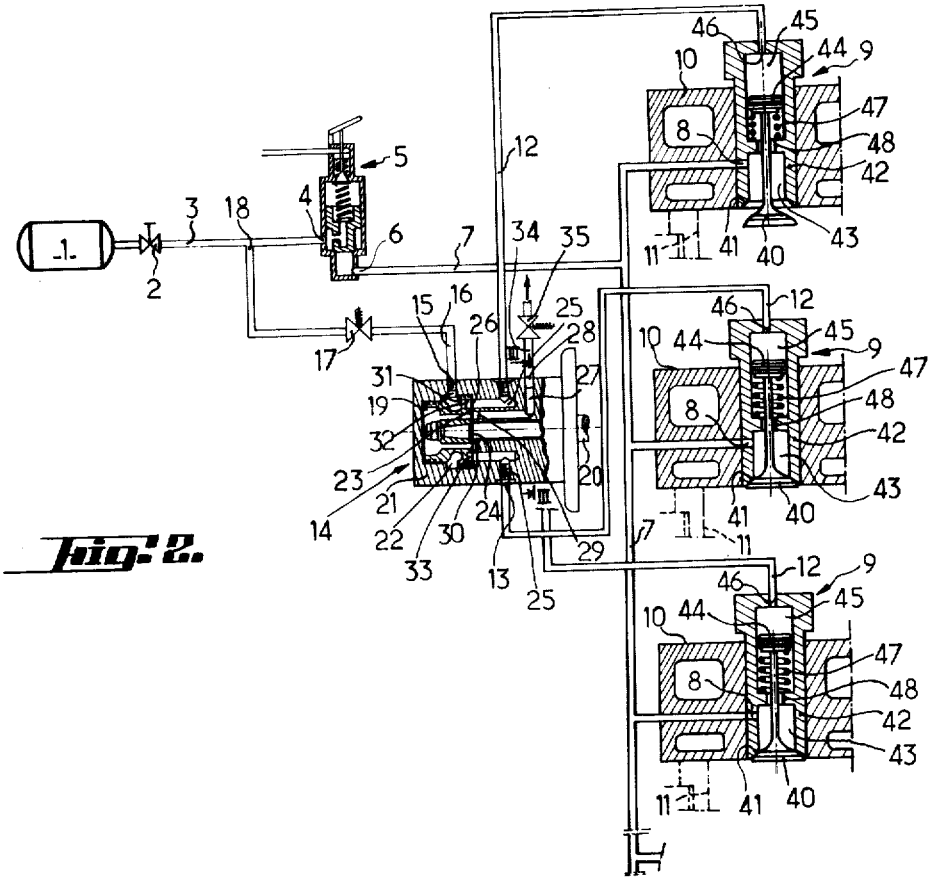
Fig. 2.
Fig. 3.
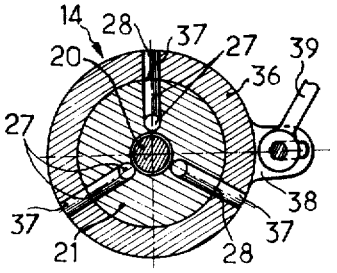

PNEUMATIC METHOD AND DEVICE FOR DIESEL ENGINE BRAKING AND RESTARTING IN THE REVERSE DIRECTION

The present invention relates generally to and has essentially for its object a pneumatic method of braking and re-starting in the reverse direction a reciprocating-piston fuel-injection internal combustion engine, especially of the compression self-ignition type, in particular a Diesel engine, as well as a device for carrying out the said method. The invention also relates to the various applications and utilizations resulting from the reduction to practice of the said method and/or the said device, as well as to the systems, assemblies, apparatus, machines, motorized units or appliances and automotive vehicles more particularly floating ones such as ships or vessels and the power generating equipments or plants provided with such devices.

It is known for example that, as a rule, ships that are propelled by marine Diesel-engines of the multi-cylinder reversible type by means of propellers of for example the constant-pitch type, either directly or indirectly through the medium of speed-reducing gears, offer good workability, handiness or maneuverability, but the latter decreases as the speed and/or inertia of the ships increases. When the supply of the engine with fuel on a ship under way is discontinued, considerable time elapses before the ship stops, and the distance which it covers until it stops may sometimes reach several kilometers. In the event of a danger or an emergency, for example a risk of collision, distress or the like, it is necessary to rapidly perform an emergency operation intended to stop or immobilize the ship or vessel. The engine of the vessel is running at full speed, for example in the direction of ahead movement, and stopping within as short a space of time as possible is necessary, preferably by a rapid reversing of the ship's movement. In order to reverse the engine it is necessary to first stop the engine. Therefore the engine must be allowed to slow down rapidly until it stops and then restarted in the reverse direction. Such an emergency operation may prove to be difficult with an internal combustion engine, for the engine is driven through the medium of the propeller in the direction of for example ahead movement, by the inertia of the ship. In order to reverse and start the engine in the direction of astern movement of the ship it is necessary to wait until the rotary speed and the forces of inertia decrease to a sufficient extent. Moreover, since the efficient braking surface of the engine pistons diminishes in proportion to the dimensions and the speed of the ship, the greater the mean pressure in the cylinders and the rotary speed of the engine, the greater the risk of encountering operating difficulties in the case of highly supercharged internal combustion engines.

Several pneumatic braking methods have been used in the prior art, taking advantage of the fact that the engine produces a high braking torque if its compression work can be utilized for braking while at the same time reducing as much as possible the expansion work. The Diesel engine is generally provided with a compressed-air starting system according to which each one of all or of only some of the engine cylinders is provided with an auxiliary valve. The auxiliary or pneumatic starting valve directly receives the starting main-compressed-air and introduces the air into the cylinder at the right time. The pneumatic starting valve is provided with and opened by a single-acting pneumatic actuator fed with and operated by a pilot or control compressed-air pressure separately supplied to the valve actuator through an auxiliary conduit. The auxiliary conduit is also used for venting or exhausting the valve control air after this valve is closed automatically, for example by means of a return spring, the action of which may be additively combined with the starting main-compressed-air pressure. The pilot or control compressed-air pressure is furnished to each starting valve according to a predetermined sequence, co-ordinated in time, by a pilot compressed-air distributing device. The distributing device is mechanically driven from a cam-shaft of the engine or in synchronism with the latter to alternately supply and discharge pressure air sequentially to and from the individual pneumatic single-acting actuators for opening and closing the starting valves. Each valve is thus directly integrated or incorporated to an actuator. The pneumatic starting system also preferably comprises at least one main starting air valve which generally is closed automatically and opened either mechanically by direct manual action or pneumatically by the operator, for example by remote control from a central control station, desk or board. The main starting air valve is intended to supply the engine cylinders with main starting pressure air through their respective individual starting air valves and is connected to a source of compressed air (usually a tank or bottles), the said main starting air valve being connected to the pilot compressed-air distributing device. According to a known form of embodiment, the distributing device comprises a series of slide-valves or the like equal in number to the cylinders to be supplied with compressed air and each of which is associated respectively with a starting valve, i.e. to a cylinder. Each slide-valve comprises a compressed air inlet and a pilot compressed air outlet for the associated starting valve, the air-venting step being carried out through the action of the slide-valve. The slide-valves may either be mounted individually in proximity to each of the cylinders which they serve, or grouped in star-like configuration and located at one end of the engine. In the first case, each slide-valve is actuated in a predetermined sequence by an individual cam secured on a cam-shaft of the engine or driven by the latter, and, in the second case, all the slide-valves are actuated in a predetermined sequence by a single or common control cam mounted on a cam-shaft of the engine or driven thereby. According to another known form of embodiment, the distributing device is of the rotary type, also ensuring the aforesaid exhaust and in which the compressed air is distributed by a rotary perforated disc to each starting valve. In a further embodiment, the starting valve may be an ordinary air-intake valve which is opened by the starting main starting-compressed-air pressure and admits the latter into the cylinder for the purpose of expansion. Such a rotary distributing device, which is common to all the starting valves, has its rotary disc generally driven by a cam-shaft or the like of the engine. in a reversible engine, the cam-shaft or each cam-shaft of the engine comprises forward-movement-cams and reverse-movement-cams and each cam-shaft is movable axially in rectilinear translation so that it can be selectively displaced alternately between two end positions corresponding to the operation of the forward-movement-cams and the reverse-movement-cams, respectively.

The running direction of the Diesel can be reversed in the course of operation, after discontinuing the fuel supply and moving each cam-shaft to its position for running the engine in the reverse direction. A known method of exerting a braking action on the engine during the slowing-down stage consists in opening the main starting valve as soon as the rotational speed is sufficiently reduced. During this process, the ship's propeller driven by the flow of water continues to drive the engine in its initial direction of rotation. Owing to the present position of each cam-shaft, already moved to its position for running the engine in the reverse direction, the main starting-compressed-air passes through the starting valves largely opened during the compression stroke and enters the cylinders where it produces a braking action on the ascending motion of the pistons. When the pressure in the cylinders is higher than that of the main starting-compressed-air, part of the air is forced by the engine back through the starting valves into the main starting-compressed-air piping in a direction opposite to and against the starting compressed-air pressure, thus producing a considerable braking torque (untimely starting). The drawback of this known method is that during the following expansion stroke the expansion work is ensured only by the air still left in the cylinders. Moreover, if the engine has many cylinders and therefore long conduits, pipings or ducts connecting the compressed-air distributing device to the various starting valves on the cylinders, there may occur such a delay in the feeding of these valves that the engine, instead of being subjected to a braking action, is on the contrary driven by the main starting-compressed-air in the same direction of rotation as before, so that it is necessary to wait untill the engine slows down naturally.

Another known braking method consists in drawing the pilot compressed air directly from the source of compressed air without passing through the main starting valve, and in conveying the same to the aforesaid distributing device through a cut-off or isolating valve. Since the starting valves are open only during a portion of the ascending stroke and the descending stroke of the engine pistons and since the air leaving the combustion chamber of each cylinder can enter and leave the starting main-starting air-pipe is not under pressure and the cylinders can allow much greater amount of air to escape through the starting valves. The air escapes into the starting compressed-air pipe during the compression stroke, especially in the region located a little before the top dead centre, where the compression in the cylinders is at a maximum and where motion of the pistons are is considerably reduced. At the same time, the air pressure in the cylinders diminishes considerably and the next expansion stroke starts with a considerably reduced pressure level, so that the expansion work remaining to be performed is only very small. The main starting valve is opened only when the rotational speed of the engine is practically reduced to zero.

Still another known pneumatic braking method consists in simultaneously opening all the starting valves on the cylinders and permanently keeping them open during the whole braking period. The starting valves are kept open by drawing the compressed air directly from the source of compressed air upstream of the main starting valve and by conveying it through a controlled cut-off or isolating valve directly to the respective individual actuators of the starting valves on the cylinders without passing through the aforesaid pilot air distributing device, while at the same time keeping closed the main starting valve (and therefore the intake of launching main compressed air into the cylinders). In this case, the compressed air in one cylinder is forced out through its starting valve and the main starting air conduit into another cylinder, for instance the one which at that moment is in the open exhaust position, and therefrom into the exhaust manifold, so that the cylinders whose pistons operate in the same direction are subjected to a mutual braking action by this air-pumping work. The resulting braking effect on the engine is substantial, especially at high engine speeds, because this braking effect results mainly from a loss of pressure due to throttling of the air in the starting valves and offering resistance to the exhaust-air flow. It results therefrom that at low speeds this braking effect becomes small, so that the effect of a cylinder driving another one whose piston moves in the opposite direction becomes preponderant and the braking is annihilated. In order to avoid or mitigate this drawback it has been proposed to allow the air in the starting main air-conduit to be constantly exhausted to the atmosphere during the braking stage, in particular by means of an additional exhaust or vent-valve (which may be adjustable to allow to selectively adjust the value of the back-pressure in the cylinders). The additional valve, however, is subjected to considerable heating owing to the compression of the air, and, moreover, the air escaping from this valve is loaded with oil vapor or mist from the cylinders, thus involving a risk of sticking of the valve. In this known method one has to wait until the engine is almost stopped by this pneumatic braking before opening the main starting valve to start the engine in the opposite direction. Another drawback of this known method is that it requires the use of a special additional by-pass duct for directly supplying the starting valves with pilot compressed air derived from a point upstream of the main starting valve or from the source of compressed air.

Therefore, the invention has mainly for its purpose to eliminate the afore-mentioned drawbacks and difficulties by providing an improved new method of pneumatic braking, resulting more particularly from a combination of the method of braking by the permanent or at least temporarily constant opening of the starting valves and the simultaneous concomitant closing of the main starting valve with the method of braking directly by means of the starting main compressed air furnished by the main starting-valve opened from the very beginning of the braking stage. It has indeed been experimentally established that in the method of pneumatic braking by means of the starting main compressed air supplied by the main starting valve the obtained braking torque diminishes as the rotational speed of the engine decreases and may even be reduced to zero and reversed by becoming negative (i.e. by producing an acceleration instead of a deceleration), and then becomes positive again by producing efficient braking work. The method according to the invention makes use of this braking effect. The invention is directed to a pneumatic starting system in which the pilot compressed-air distributing device is connected through a cut-off or isolating valve to the source of starting compressed-air upstream of the main starting valve without passing through the latter. The method of this invention is of the type consisting in successively discontinuing the fuel supply the engine, shifting each cam-shaft of the engine to a position for running the engine in the opposite direction for the purpose of changing the direction of movement of the ship, opening the cut-off valve while maintaining the main starting valve closed during the period of slowing down of the engine, and then opening the main starting valve after the engine braking is achieved. The method according to the invention is therefore characterized in that it consists, on the one hand, in preventing or in obturating the exhausts of all the aforesaid starting valves, in order, in a manner known per se, to keep the latter under pilot compressed-air pressure and to lock them in the open position during the whole braking period in order to slow down the engine by means of mutually opposing or interfering air-pumping effect or work in the cylinders. On the other hand, in opening the main starting valve as well as the exhaust when the engine has slowed down to a rotational speed at which the braking by the starting main compressed air becomes more effective than the braking by the mutually opposing or interfering air-pumping effect or work. Thus, according to the invention, the starting valves are initially kept open simply by preventing the exhaust or discharge of the individual opening-control single-acting actuators, so that the said actuators are maintained under compressed-air pressure and thus keep open the respectively associated starting valves.

The invention is also directed to a device for carrying out the said method, which is characterized by an obturating valve provided on each exhaust conduit of the aforesaid pilot compressed-air distributing device.

According to another feature of the invention, a single obturating valve is mounted on a single exhaust conduit to which lead all the exhaust paths from the distributing device.

According to still another feature of the invention, automatic means are provided for the control of the main starting valve and possibly of the obturating valve, the automatic means being monitored in follow up relationship by engine rotational speed detecting means.

The arrangements described offer the considerable advantage of extremely simple design, since it is sufficient to adjoin a simple valve, for example an electromagnetically controlled valve, on the exhaust of the distributing device and to provide means for automatic control of the valve in accordance with the actual rotational speed of the engine. The valve can be conveniently placed at a location which is not prejudicial to its operating safety or reliability and the environment. Also, it can be small in size, thus allowing inexpensive manufacture.

Thus, owing to its efficiency, simplicity and aptitude for a very economical reduction to practice, the invention provides an important technical advantage and therefore progress as compared with the existing or previously known systems without having any of their drawbacks.

The invention will be better understood and other purposes, features, details and advantages of the latter will appear more clearly as the following explanatory description proceeds with reference to the appended diagrammatic drawings given solely by way of non-limitative examples illustrating several presently preferred, specific forms of embodiment and wherein:

FIG. 1 is a graph representing the variation or evolution of the pneumatic braking torque of the engine as a function of the angular rotational speed of the latter, according, respectively, to two methods known in the prior art and to the method according to the invention;

FIG. 2 is a fragmentary view of the functional diagram of a pneumatic braking and starting system according to the invention, using a rotary compressed-air distributing device; and FIG. 3 is a cross-sectional view on a larger scale, taken the line III-III of FIG. 2, illustrating a modified form of embodiment of the rotary compressed-air distributing device in which is directly incorporated an exhaust control valve according to the invention.

In the graph of FIG. 1, the pneumatic braking moment $C_f$ is plotted in ordinates and the instant rotational speed of the engine is plotted in abscissae, evolution of the braking torque as a function of the rotational speed, in the known method of pneumatic braking by the starting main compressed air furnished by the main starting valve, is illustrated by the curve A. At the moment when the injection of fuel into the engine is stopped, the latter rotates at idling speed, for example at an angular rotational speed of about 500 r.p.m., and from the moment the main starting valve opens, i.e. from the moment the period of pneumatic braking by the starting main compressed air begins, the engine is subjected to a braking torque which decreases continuously as the engine progressively and concomitantly slows down (as its rotational speed diminishes) until it is reduced to zero at a rotational speed $N_2$ (lower than the normal idling speed) and possibly reversed by becoming negative (by producing an engine acceleration work according to the hatched region located below the $x$-axis). Thus, the braking torque by being reversed becomes an accelerating torque capable of re-starting the engine in the same direction of rotation. If such a re-starting in the initial direction does not take place, the engine continues to slow down and the negative braking torque, after having increased to an absolute maximum value, decreases until it is reduced to zero at a rotational speed $N_1$ (lower than the rotational speed $N_2$) and is reversed by becoming positive and starting to increase again (with an increasing braking action on the engine).

The curve B in FIG. 1 illustrates the second known pneumatic braking method consisting in keeping the starting valves constantly open and the main starting valve permanently closed during the whole braking stage. It is observed that at the beginning of the braking period the braking moment $C_1$ obtained is higher than the one obtained in the preceding method (curve A). As the engine is slowed down this braking moment diminishes continuously and regularly with the rotational speed and this uniformly decreasing curve B intersects the curve A at the point $C_2$ which corresponds to a rotational speed $N_o$ of the engine (lower than $N_2$ and $N_1$). Curve B meets the $x$-axis before the rotary speed is reduced to zero, so that the braking disappears or becomes inoperative before the engine is stopped.

The present invention consists in combining the aforesaid two methods, so as to use successively and partially the second one and then the first one. To this end, the starting valves on the cylinders are kept open and the main starting valve is kept closed in order to first exert a braking action according to the aforesaid braking method by following the segment $C_1$–$C_2$ of the curve B (decreasing in a monotonic manner) in order to slow down the engine to the low speed $N_o$. Maintaining the starting valves in open position is obtained by simply closing the exhaust on the compressed-air distributing device, thus neutralizing or rendering inoperative the normal cyclic periodical piloting of the starting valves by the distributing device. When the engine has slowed down to the speed $N_o$, the normal cyclic periodical piloting of the starting valves is restored and the main starting valve is opened, so that the braking now takes places according to the first method by following the uniformly increasing segment $C_2$–$C_3$ of the curve A. Braking is substantially stronger below the rotational speed $N_o$ than the one obtained along the curve B. FIG. 1 thus clearly shows that the braking along the curve B is more effective than the braking along the curve A as long as the rotary speed of the engine is higher than the critical speed $N_o$, whereas below this value the braking according to curve A becomes more effective than the braking according to curve B.

FIG. 2 diagrammatically shows the device for reducing the present invention to practice. The pneumatic starting system comprises a tank 1 of compressed air under an initial pressure of for example 30 bars (which may decrease to 6 bars in operation after repeated use, i.e. after several successive startings) connected through a stop valve 2 and a conduit 3 to the inlet 4 of the main starting valve 5 controlled pneumatically and/or mechanically by hand (for example of the type described in U.S. Pat. No. 3,371,655 issued on Mar. 5, 1968). Outlet 6 of valve 5 is connected in parallel through a conduit 7 to the respective inlets 8 of the various starting valves 9 mounted respectively in the heads 10 of the corresponding engine cylinders 11 and only three of which are shown in the drawings. The pneumatic control means for opening each starting valve 9 are connected by a piping 12 to the corresponding outlet port 13 of a compressed-air distributing device 14, the compressed-air inlet 15 of which is connected by a conduit 16 through a valve 17, for example a remote-controlled electromagnetic valve, to the conduit 3 (and therefore to the tank 1) at a branching-off point 18 located between the valve 2 and the main starting valve 5 (therefore upstream of the latter).

The distributing device 14 is advantageously but not exclusively, in particular of the rotary type, for example of the kind described and represented in U.S. Pat. No. 3,722,210. The rotary distributing device comprises essentially a rotary distributing disc 19 co-axially secured to a shaft 20 rotatably mounted in the stator body 21 of the distributing device and driven in rotation by a cam-shaft of the engine. The disc 19 thus rotates in a cavity 22 of the body 21 while its face 23 forming for example a specular polish mirror is applied in sliding fluid-tight contact against an internal mating flat face 24 of the body 21. The distribution of compressed air in the body 21, for the purpose of supplying the various starting valves on the cylinders, is ensured by supply conduits 25 equal in number to the engine cylinders provided with individual starting valves. The conduits 25 open onto the external sides of the body 21, preferably through substantially radial ports or orifices 31, each of which is connected through an aforesaid piping 12 to the starting valve 9 of an individual cylinder 11 of the engine. Each conduit 25 advantageously comprises a substantially rectilinear portion the longitudinal direction of which is substantially parallel with the axis of rotation of the rotating assembly 19, 20 and which opens in the front face 24 of the body 21 through an orifice 26. All the orifices 26 are preferably equidistant from the axis of rotation 20 and uniformly distributed at equal angular intervals on one and the same circumference in concentric relationship to the said axis of rotation. The supply conduits 25 also serve to exhaust the pilot compressed air from, respectively, the individual actuators for the pneumatic control of the respective starting valves 9, and preferably several exhaust conduits such as 27 are provided to this end and open onto the external sides of the body 21 through preferably substantially radial ports 28. Each exhaust conduit 27 advantageously comprises a substantially straight portion the longitudinal direction of which is substantially parallel with the axis of rotation of the rotary assembly 19, 20 and which opens through a corresponding orifice 29 into a circular groove 30 forming a passage-way in coaxial relationship to the axis of rotation 20 and opening onto the front face 24 of the body 21, so that all the orifices 29 are thus connected by the common circular passageway 30. Only two supply conduits 25 and a single drain conduit 27 are shown in FIG. 2 although their respective numbers are greater than those appearing in the drawing.

Through distributing disc 19 is extending, in parallel relation to the axis of rotation 20, a compressed-air passage orifice 31 opening on one side (opposite to that of the front face 24 of the body) into the annular space 22 and, on the other side, into the bottom of a recess 32 in the shape of an arcuate slot extending in concentric relationship to the shaft 20 and cut in the face 23 of the disc 19, so as to open that face. The recess 32 is thus approximately in the shape of a lunula with rounded ends or in the shape of a bean, the radial width of which is equal to the diameter of the orifice 31 and the mean line of the arc of circumference of which passes through the centre of the said orifice 31. The latter is equal in diameter to the orifices 26 and the radial distance between the centre of the orifice 31 and the geometrical axis of rotation of the shaft 20 is equal to that of the orifices 26, so that the orifice 31 can occupy a position exactly opposite to each of the successive orifices 26 during the rotation of the disc 19. The curvilinear length of the recess 32 along its medial arc of circumference corresponds to a centre angle smaller than the angular spacing between two successive orifices 26, i.e. smaller than the circumferential distance between their centres but greater than the circumferential spacing between two successive orifices 26, i.e. greater than the curvilinear length of the solid face portion separating them. Thus the recess 32 may simultaneously cover part of each of two successive orifices 26, which means that an orifice 26 begins to be fed before the recess 32 leaves the orifice 26 immediately preceding it in the direction of rotation of the disc, in order to ensure the continuity of compressed-air distribution from one cylinder to the following cylinder to be fed, only one cylinder being fed every time in the present example.

In the face 23 of the disc 19 is also cut an arcuate slot 33 which opens on to the face 23 and is substantially symmetrical with respect to the axis passing through the centre of rotation of the disc 16 and the centre of the orifice 31 and is substantially diametrally opposite to the recess 32 (which also is symmetrical with respect to the said axis). The slot 33 extends in concentric relationship to the axis of rotation of the disc 19 and the radius of its medial arc of circumference is equal to the distance from the centre of each orifice 26 to the said axis of rotation. The radial width of the slot 33 is substantially equal to the diameter of each orifice 26 and its circumferential length along its medial line is such that when the orifice 31 is opposite to an orifice 26 all the other orifices 26 are opposite the slot 33 so as to together communicate with the latter. Each end of the slot 33 is laterally notched radially and inwardly to form an at least approximately semi-circular recess whose radius is at least equal to that of each of the orifices 29 or to the radial width of the annular passageway 30. The two notches are symmetrical with respect to the axis passing through the centre of rotation of the disc 16 and through the centre of the orifice 31 and the circumference passing through the centres of curvature of both notches is concentric to the axis of rotation 20 and has a radius at least equal to the mean radius of the passageway 30 or to the radial distance from the centre of each orifice 29 to the said axis of rotation. Thus, whatever the angular position of the disc 19, the slot 33 permanently communicates through the medium of the said notches with the annular passageway 30 of the body, therefore with the exhaust orifices 29 of the latter. The circumferential length of the arcuate slot 33 is such that when the disc orifice 31 is opposite to an orifice 26 of the body 21, all the other orifices 26 exhaust to free air through the medium of the slot 33, the aforesaid notches, the passageway 30 and the corresponding orifices 29. When the recess 32 straddles two successive orifices 26 to ensure the continuity of compressed air supply when passing from a supply cylinder to the following cylinder to be supplied, the two orifices 26 do not communicate with the slot 33 and therefore do not exhaust. In FIG. 2, one of the conduits 25 (the lower one in the figure) is shown as communicating with the exhaust slot 33 of the rotary disc (therefore with the annular passageway 30 of the body 21 and with at least one exhaust conduit 27), whereas another conduit 25 (the upper one in the figure) is shown as communicating with the through-orifice 31 of the disc. The port 15 of the distributing device body, to which the compressed air intake conduit 16 is connected, opens into the cavity 22 of the body 21 of the distributing device, on that side of the disc 19 which is opposite to the front face 24 of the body.

According to the form of embodiment shown in FIG. 2, all the exhaust ports 28 of the distributing device 14 are preferably connected to a single exhaust conduit 34 provided with a valve 35, for example of the electromagnetic type remote-controlled from the central control station.

FIG. 3 illustrates another embodiment of the control system for selectively opening and closing the exhaust conduits 27. In this embodiment of a rotary distributing device 14 all the exhaust paths provided in the body 21 open radially outside through respectively corresponding lateral ports 28 arranged along a common circumference in coaxial relationship with the said body. In the example of embodiment shown in FIG. 3, the valve for obturating the exhaust ports comprises an annular obturating member 36 mounted rotatably on and in fluidtight relation to the body 21 of the distributing device 14 over the exhaust orifices 28 so as to cover the latter and to open or close them simultaneously through selectively controlled angular displacement of the obturating member 36 in respectively opposite directions of rotation. The obturating member 36 is provided with radial holes 37 equal in number to the exhaust orifices 28 and arranged at angular intervals corresponding to the angular intervals between the ports 28, so that in the open position of the obturating member 36, the radial holes 37 are located opposite and in aligned relation to the exhaust ports 28, whereas in the closed position the obturating member 36 sealingly closes the drain ports 28. According to the form of embodiment described and illustrated in the afore-mentioned U.S. Pat. No. 3,722,210, the respective radial portions of the exhaust conduits 27 advantageously open through their respective end orifices 28 into a common peripheral groove forming a circular discharge passageway extending for example in substantially concentric relation to the cylindrical body 21 of the distributing device 14 and open outwardly so as to interconnect the various exhaust orifices 28. In this case, the rotary obturating member 36 advantageously consists of a ring inserted rotatably in the said peripheral groove in sliding and fluidtight relationship thereto. To allow the obturating member 36 to be actuated in rotation, alternately if suitable, it is advantageously provided with a clevis or the like 38 to which is hingedly connected (in a manner kinematically compatible with the rotary motion of the obturating member, for example by means of a guide slot or oblong aperture system) an actuating rod 39 connected either directly or through the medium of a suitable transmission mechanism to an associated actuating servomotor (not shown) such as for example an actuator operated by a fluid under pressure, more particularly of the linear displacement type with a cylinder and a piston and advantageously of the double-acting or reversible type. This servomotor is advantageously remote-actuated by the operator from the central control station.

Each starting valve 9 on an engine cylinder comprises, in a manner known per se, the obturating element 40, for example in the shape of a mushroom valve which opens by moving forward into the associated cylinder 11 and closes by returning or moving backward and applying its head against a valve seat 41 secured to the valve box 42. The starting main compressed air intake conduit 7 opens through the lateral orifice 8 into the cavity 43 of the valve box 42 which communicates with the internal space of the cylinder 11 or is separated from the latter in the respectively open and closed positions of the obturating member 40. The valve rod of the obturating member 40 extends upwardly and ends with a piston 44 sealingly sliding in a cylindrical cavity 45 forming an upper extension and constituting an integral part of the valve box 42 to thus form with the piston 44 a fluid-operated single-acting actuator for the control of the valve 9. Through the end wall of the cavity 45 of this integrated actuator opens the pilot compressed-air supply conduit 12 through the inlet orifice 46. An antagonistic or opposing return-spring 47, for example of the compression helical type, coaxially surrounds the rod of the obturating element 40 and has its lower end applied against an internal annular collar or shoulder 48 of the valve box, through which slidingly passes the valve rod. The opposite end of spring 47 bears upon the adjacent face of the piston 44 which is located on the valve rod side, so as to constantly tend to automatically urge the obturating element 40 of the valve towards its closing position in the absence of fluid under pressure in the cavity 45 (i.e. when this cavity is exhausted through the conduit 12, the exhaust conduits 27 of the distributing device 14 and the valve 35 or 36 in the open state). This principle of construction of the starting valve 9 is given purely by way of nonlimitative example, for a great number of other structural configurations are also possible.

The device of the invention is operated as follows in order to stop the Diesel engine assumed to be initially rotating for example in the direction of forward movement and to re-start the same in the reverse direction or the direction of astern movement of the ship. After cutting off the fuel supply or injection and displacing each cam-shaft from its initial forward movement position to its reverse movement position, assuming the main starting valve 5 to be closed, the stop valve 2 and the valve 17, for example of the electromagnetically controlled type, are opened by the operator through remote-control from his central control station or board in order to supply the distributing device 14 with compressed air. He also closes the separate valve 35, which also is for example of the electromagnetically remote-controlled type, or the valve 36 incorporated in the distributing device 14 and for example remote-controlled electropneumatically to block the exhaust of the cavity 45 of all the starting valves 9 on the cylinders. All the cavities 45 are then supplied with pilot compressed air and kept constantly under pressure, so that each piston 44 and the associated valve 40 integral therewith are pushed downwards to a permanently open position by overcoming the force of the return-spring 47. In FIG. 2, the starting valve at the top is shown in open position and the others in closed position.

Owing to this locking of all the starting valves in the open position, the cyclic periodical normal piloting of these valves by the distributing device 14 is temporarily neutralized, so that the engine is thus subjected to a pneumatic braking action which slows it down progressively from its normal idling speed. When the braking action has reduced the rotational speed of the engine to the aforementioned critical value $N_o$ (indicated in FIG. 1), the operator opens the valve 35 (or 36) in order to restore the cyclic periodical normal piloting of the starting valves by the distributing device 14 and he then also opens the main starting valve 5 so as to supply the engine cylinders with starting main compressed air which continues the braking action on the engine until it completely stops and then re-starts it in the opposite direction or direction of reverse movement.

The main starting valve 5 and the valves 35 or 36 are advantageously monitored or controlled through a suitable automatic servo-control system by an engine speeddetecting apparatus by which the main starting valve 5 and the valves 35 or 36 are kept locked in the closed position until the engine speed has been reduced to $N_o$, and are thereafter released in order to allow their opening. When the engine is re-started pneumatically in the opposite direction the operator ensures fuel supply or injection to allow the re-starting and closes the main starting valve 5 as well as the valves 2 and 17.

Of course, the invention is by no means limited to the forms of embodiment described and shown which have been given by way of examples only. In particular it comprises all the means constituting technical equivalents of the means described as well as their combinations if same are carried out according to its gist and used within the scope of the appended claims.

What is claimed is:

1. A method of pneumatically braking a running, reversing engine having a plurality of cylinders at least some of which are provided with permanently intercommunicating individual starting air valves which are selectively simultaneously supplied with and cut off from main starting air pressure and which are alternately opened and closed during each normal engine starting period for allowing and discontinuing admission of said main starting air pressure therethrough to the cylinders; an engine-driven cam means for each cylinder, which cam means is selectively shiftable between a forward-run cam-operative position and a reverse-run cam-operative position, said method comprising braking said engine in two successive stages and comprising (a) a first stage of (1) keeping the main starting air pressure shut off from said starting air valves; (2) cutting off fuel supplied to said cylinders; (3) shifting said cam means to a position for running said engine in the reverse direction; (4) causing said starting air valves to open in a proper sequence and time relation to the cycle of the cylinders and preventing the starting air valves from being closed so as to remain open for a major part of said first stage in order to brake the operation of said engine through the mutually opposing air-pumping work of the engine cylinders which communicate with each other through their starting air valves having remained open; (5) allowing the engine to slow down to a particular rotational speed at which the braking by the admission of main starting air pressure to said cylinders in their normal reverse starting sequence becomes more effective than the braking by said air-pumping work; and (b) a second stage of (1) allowing said starting air valves to close and to resume their normal sequential operation; and (2) feeding main starting air pressure simultaneously and continuously to all of said starting air valves at least until said engine is stopped.

2. A method according to claim 1 comprising providing a first graphical curve of the braking torque produced with the main starting air pressure supply cut off and all starting air valves left open against rotational engine speed, and a second graphical curve of the braking torque provided by the admission of said main starting air pressure to said cylinders in their normal reverse starting sequence; and determining said particular rotational speed by the point of intersection of both of said first and second curves.

3. A method according to claim 2, wherein each starting air valve is pneumatically opened intermittently by applying control air pressure at proper periods in time relation to the operating cycle of the corresponding working cylinder automatically closed when the control air pressure supply is discontinued and allowing the control air pressure to vent and wherein said step of holding each starting air valve open comprises preventing said control air pressure to be discharged from said starting air valve whereby air pressure remains to the valve and holds the valve in the open position.

4. A method according to claim 2, further comprising the steps of controlling the braking in accordance with the actual engine speed by detecting said engine speed and using the sensed engine speed value for monitoring and operating the change from said first stage to the second stage.

5. An engine comprising an engine-driven cam means shiftable between a forward operative position and a reverse operative position; a source of main starting air pressure; a starting air valve for at least some of the engine cylinders, each starting air valve including a single main starting air pressure inlet, biasing spring means urging said valve towards a closed position and a self-contained single-acting pneumatically operated actuator for opening said valve against said spring means, said actuator being provided with a single feed and vent port for feeding and discharging control air pressure to and from said actuator; means interconnecting together the inlets of all starting air valves in parallel relationship; rotary control air pressure distributor means driven by said cam means, said distributor means including a single main starting air pressure input port connected to said source of air pressure through a cut-off valve and having as many output ports as there are starting air valves, said output ports being connected to said feed and vent ports of said starting air valve actuators, respectively, and venting outlet means provided with shut-off valve means, said output ports being sequentially and alternately connectable and disconnectable through said distributor means with and from said main starting air pressure input port and said venting outlet means; and a main starting air valve having an air output connected to said interconnecting means and an air input connected to said source of pressure air.

6. An engine according to claim 5, further comprising engine speed detecting means and control means for automatically operating said main starting air valve and said shut-off valve means, said control means being monitored by said engine speed detecting means.

7. An engine according to claim 5, wherein all of said distributor venting outlet means are connected to a single vent and said shut-off valve means comprises a single shut-off valve inserted in said vent.

8. An engine according to claim 7, wherein said distributor means comprises a substantially cylindrical stationary casing and said venting outlet means comprises passageways in said casing and extending radially to the circumference of the casing, through a plurality of corresponding respective side ports which are coaxial with the casing; said shut-off valve comprises an annular member rotatably mounted on and in fluid-tight surrounding relationship with said casing, said annular member having a like plurality of radially extending ports through the member, in order to cover and uncover all of said side ports at the same time through selectively controlled angular displacement of said annular member.

* * * * *